United States Patent [19]

Broomfield

[11] 3,949,945

[45] Apr. 13, 1976

[54] BOBBIN TERMINATOR

[75] Inventor: John Broomfield, Bolton, Mass.

[73] Assignee: Amacoil Machinery, Inc., New Rochelle, N.Y.

[22] Filed: Aug. 1, 1974

[21] Appl. No.: 493,776

Related U.S. Application Data

[63] Continuation of Ser. No. 224,686, Feb. 9, 1972.

[52] U.S. Cl. ..... 242/7.17; 242/7.03; 242/7.14

[51] Int. Cl.[2] ..... H01F 41/06; H01F 41/10

[58] Field of Search ..... 242/7.18, 7.17, 7.06, 7.14, 242/7.03

[56] References Cited

UNITED STATES PATENTS

| | | | |
|---|---|---|---|
| 1,514,852 | 11/1924 | Grondahl | 242/7.18 |
| 2,655,953 | 10/1953 | Miloche | 242/7.17 |
| 2,855,159 | 10/1958 | Mallina | 242/7.18 |
| 3,314,452 | 4/1967 | Cartwright et al. | 242/7.03 X |

*Primary Examiner*—Billy S. Taylor

*Attorney, Agent, or Firm*—Jordan B. Bierman; Linda G. Bierman; Kenneth J. Stempler

[57] ABSTRACT

Apparatus for wrapping wire on the terminals of a wire carrying bobbin employs a notched gear for engaging the wire. The rotation of the notched gear having the wire passing through the notch wraps the wire around the bobbin terminal. The notched gear is pivoted for breaking the wire after wrapping has been completed.

3 Claims, 7 Drawing Figures

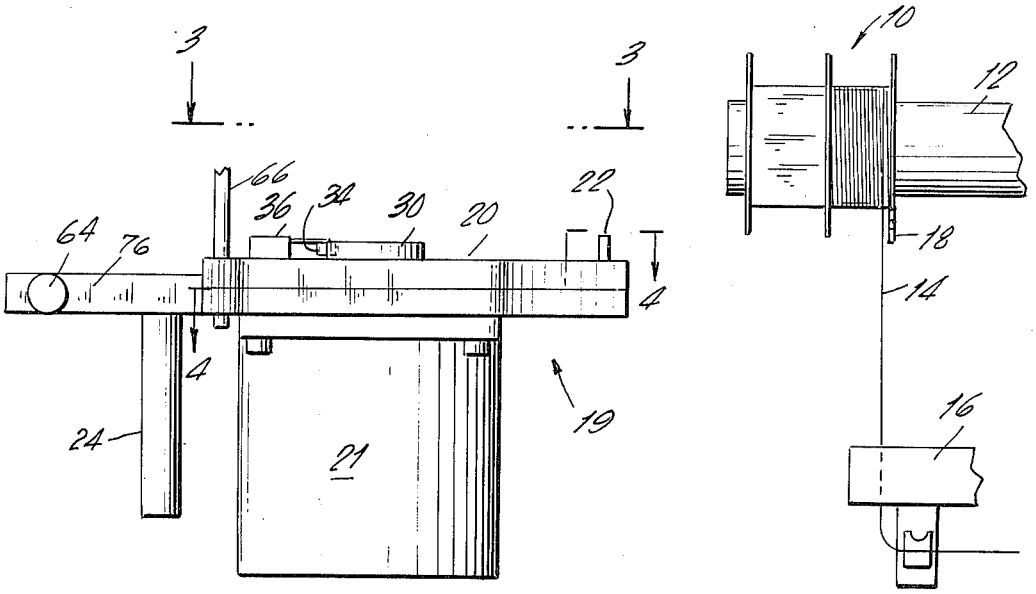
FIG. 1
FIG. 2
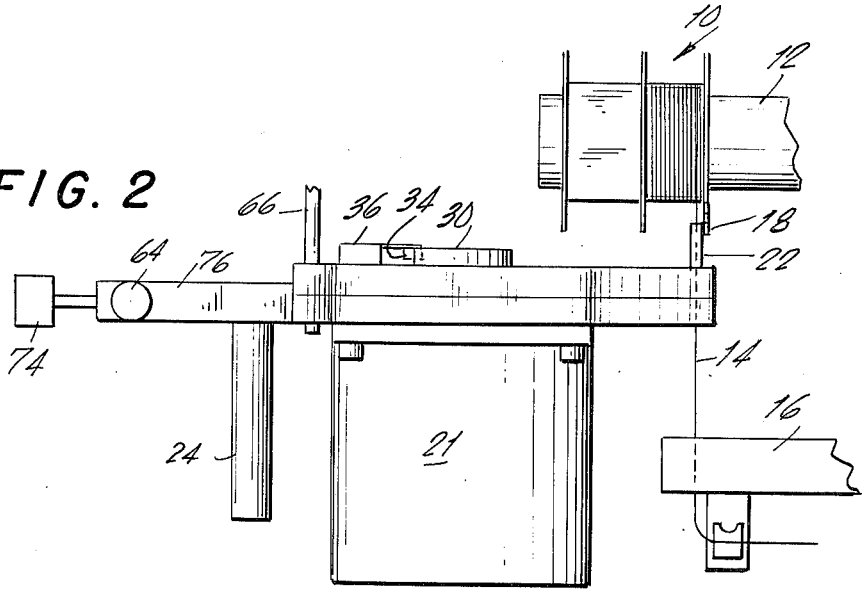
FIG. 3
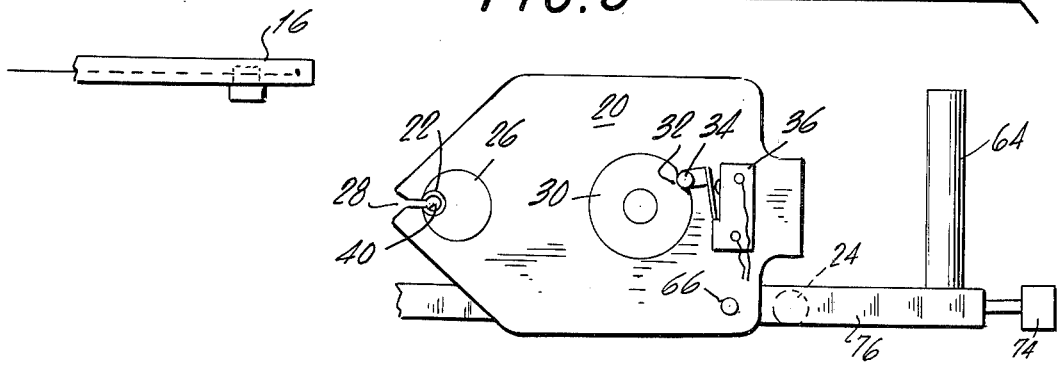

BOBBIN TERMINATOR

This is a continuation of copending application Ser. No. 224,686.

This invention relates to apparatus for winding wire and more particularly to an apparatus for wrapping wire on the terminals of a wire carrying bobbin.

In accordance with the present invention, apparatus is provided for engaging a wire extending from a bobbin and for wrapping the wire tightly on the terminal.

In most automatic bobbin winding systems, the wire extending from the bobbin will be held under tension for easy handling by the winding apparatus. In either case, after the wire has been wrapped around the terminal a desired number of times, the apparatus may be pivoted to break the wire neatly at the edge of the terminal if desired.

The apparatus of the instant invention comprises a housing having a wire carrying means therein for engaging a wire extending from the bobbin. The wire carrying means has means for rotating the wire on the terminal of the bobbin associated therewith.

In its preferred form, the apparatus wire carrying means in part comprises a housing having a flared guide into which a first gear having a notch extends. The notch is normally aligned with the guide so that the wire passes through the guide and into the notch. In addition, a hollow cylindrical protrusion with a lateral groove is provided adjacent to the guide. The groove is in alignment with the notch so that the wire is also held within the protrusion.

The apparatus is positioned so that the protrusion will rotate around the terminal, thus wrapping the wire thereon. Rotation may be achieved by means of a motor connected to a second gear whose teeth mesh with the teeth of the first gear. At the end of the rotation cycle, the apparatus is pivoted and the wire is broken.

Now turning to the drawings of a preferred embodiment of the present invention wherein like numerals refer to like parts:

FIG. 1 is a top elevated view of the apparatus before engaging the wire.

FIG. 2 shows the apparatus of FIG. 1 in operational position.

FIG. 3 is an approximately full scale view of the housing, taken along line 3—3 of FIG. 1.

Figure 4:
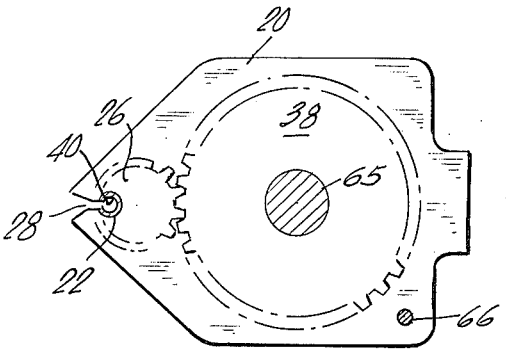
FIG. 4 is an approximately full scale view of the housing of FIG. 1 taken along line 4—4 of FIG. 1.
Figure 5:
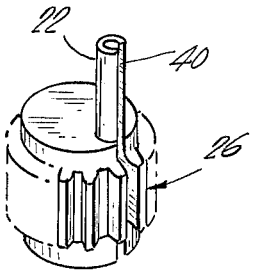
FIG. 5 is an enlarged detail view of one of the gears in the housing.
Figure 5:
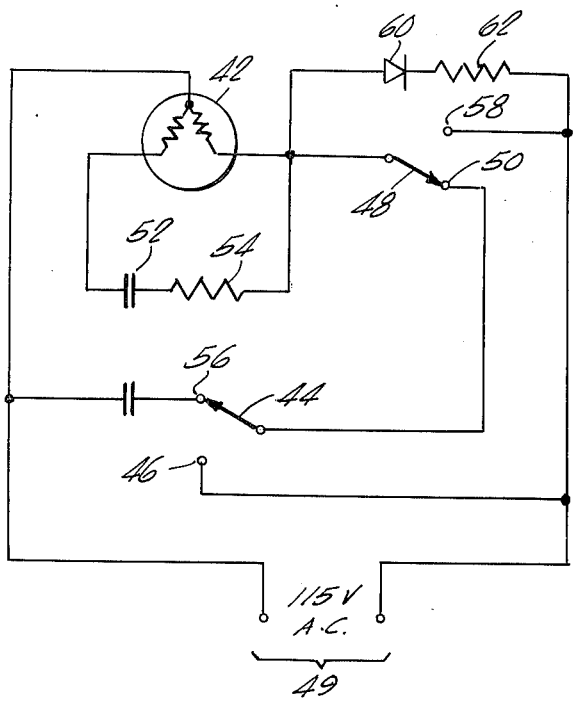

The apparatus 19 for wrapping wire on the terminals of the bobbin is normally set up for automatic operation, and has a casing 21 containing a motor and a housing 20 enclosing a plurality of gears 26 and 38. As is readily appreciated from FIG. 1, the apparatus is initially out of contact with the wire 14. In this initial position, bobbin 10 is held securely by a bobbin holder 12, wire 14 has already been wound around and is extending from bobbin 10 in a position generally parallel to terminal 18. The wire 14 is held under tension by feeding means 16.

FIG. 3 shows a side view of the housing 20 along lines 3—3. Gear 26 is rotatably mounted in housing 20. Gear 26 has a notch 40 aligned with guide 28 provided on the forward section of housing 20. A protrusion 22, is mounted on gear 26. The protrusion 22 has a lateral groove which is also aligned with guide 28 to permit wire 14 to pass into notch 40 and protrusion 22 for engagement by housing 20 when the housing is moved into operating position.

FIG. 4 shows the inside of housing 20. As shown, the teeth of gear 26 are meshed with the teeth of a gear 38. Gear 38 is fixedly mounted to shaft 65 of a motor (not shown) located on the opposite side of housing 20 directly behind gear 38 as seen in FIG. 4.

A cam 30, shown in FIG. 3, is mounted on the gear 38, cam 30 extends to the outside of housing 20 and has a cam track 32 on its extended portion. A cam follower 34 is provided in contact with the circumference of cam 30 and initially with cam track 32. The base of cam follower 34 is connected to a single pole double throw microswitch 36 which is also mounted on the side of housing 20.

FIG. 2 shows housing 20 at the start of a wrapping cycle. The housing 20, lever 76, air cylinders 24 and 64 shown in the drawings are mounted for inward translation on a movable section of the frame of the apparatus (not shown). Extension of the piston of air cylinder 74 moves the housing 20 from the position shown in FIG. 1 to the position shown in FIG. 2. The housing 20 has been translated by an air cylinder 74 from an initial position as shown in FIG. 1 to an operating position as shown in FIG. 2 where the wire 14 has passed through groove 28 and is contained within notch 40 and protrusion 22. The outer end of protrusion 22 is now located adjacent to the base of terminal 18 but slightly off to the side. The motor (not shown) is automatically activated upon the translation of apparatus 19 into operating position and gear 38, connected to the shaft 65 of the motor, begins to rotate. The rotation of gear 38 rotates cam 30. Gear 26, whose teeth are meshed with the teeth of gear 38 is rotated as the gear 26 rotates, the protrusion 22 and wire 14 contained therein are caused to revolve around terminal 18 to wrap wire 14 on the terminal. The housing 20 can be moved in a transverse direction to permit its use with different types of bobbin 10 and to move the housing 20 closer to the bobbin. To achieve this, a conventional air cylinder 24 is provided. Cylinder 24 is connected to lever 76 and its piston is connected to the frame (not shown) so that movement of the piston will effect a repositioning of the housing 20.

For best results, gear 26 should have a gear ratio with respect to gear 38, such that for one complete revolution of the gear 38, gear 26 will rotate a number of times equal to the number of wrappings desired on the terminal. Thus the whole wrapping cycle takes place during the time gear 38 goes through one complete revolution.

Figure 7:
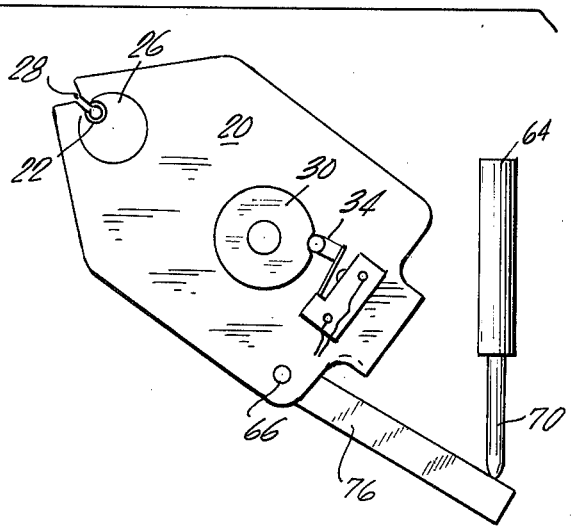
FIG. 7 depicts the apparatus of FIG. 1 pivoted to a position in which the apparatus will break the wire.

When cam follower 34 detects one full rotation of the cam 30 by sensing the return of cam track 32 to its original location, switch 36 is operated to deactivate the motor and the wrapping cycle is then complete. Wire 14 at this point is fully wrapped around terminal 18 and remains within apparatus 19. Simultaneously, with deactivation of the motor switch 36, cylinder 64 is activated to pivot apparatus 19 about a bar 66 and away from the bobbin holder 12 as shown in FIG. 7. Apparatus 19 is mounted on lever 76. A bar or pin 66 extends through both housing 20 and lever 76 and is slidably connected to a portion of the frame (not shown). Cylinder 64 is mounted above lever 76 and has its piston 70 resting on the lever (see FIG. 7). When cylinder 64 is activated, the piston 70 extends to pivot lever 76 and housing 20 about pin 66 to the position shown in FIG. 7. This pivoting movement breaks the wire at the terminal 18 and the operation is complete.

The pivoting motion of the apparatus 19 bends the wire at the terminal. Stress concentration occurs in the bent portion of the wire, thereby assuring that the wire will break at the terminal itself.

Figure 6:
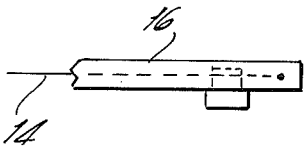
FIG. 6 is a schematic of a preferred form of circuit.

The circuitry of switch 36 is shown in FIG. 6. Switch 44 comprises a set of single pole double throw contacts of a relay (not shown) which is located in the base of the machine. The relay receives a pulse of current of short duration from a conventional drum sequence switch (not shown) upon the movement of apparatus 19 located in the base of the apparatus (not shown) into operating position to engage wire 14. Upon receiving the pulse switch 44 removes the braking current from motor 42 momentarily breaking contact with terminal 46 during which time motor 42 revolves sufficiently to bring cam follower 34 of switch 48 to the top of cam 30. During the time interval when cam follower 34 is at the top of cam 30, switch 48 is in contact with terminal 50 and motor 42 is operational. Switch 48 remains in this position for one revolution of the motor shaft and cam 30.

After one full revolution cam follower 34 again rests in the bottom of cam 30. Switch 44 is in contact with wire terminal 46 to apply braking current to the motor through switch 48. Switch 48 in this position is connected to terminal 58 by the action of cam follower 34 whereby rectifier 60 and resistor 62 complete a direct current braking circuit to stop motor 42 from turning gear 38. The cycle is then complete.

The entire cycle has a duration of less than ¾ of a second. It is therefore necessary that the pulse of current given to the coil of switch 44 be of very short duration to make sure switch 44 is in contact with terminal 46 before the completion of the revolution.

Motor 42 can be of the type 55-25 Slo-Syn motor of the type produced by Superior Electric Company. It is a stepping motor herein used as an A.C. driving motor.

It is to be understood that many modifications of the above described apparatus may be made by those skilled in the art. It is intended to over all such modifications which fall within the spirit and scope of the invention as defined in the appended claims.

Although the term will usually refer to a metal, it is meant to include any filamentary material, such as thread, filamentous plastic etc.

What is claimed is:

1. An apparatus for wrapping wire on the terminals of a wire carrying bobbin comprising;

a bobbin holder, a housing having a forward portion, said portion having a flared guide, a rotatable first gear mounted in said housing, said first gear having a notch on its periphery between two of the teeth, said notch being in alignment with said guide at the initial position of the first gear, a hollow cylindrical protrusion fixably mounted on the face of said first gear, said protrusion having a lateral grove positioned in alignment with said notch, means for moving said housing to an operating position such that said notch is offset from the axis of said terminal, means for rotating said first gear, and, means for pivoting said housing to break said wire when rotation of said first gear termintates.

2. The apparatus according to claim 1 further comprising;

means for holding and feeding the wire whereby the wire passes through the guide and into the protrusion when the housing is moved into operating position and is fed while remaining taut during the wrapping operation.

3. An apparatus for wrapping wire on the terminal of a wire carring bobbin comprising;

a bobbin holder, a housing having a forward portion, said portion having a flared guide, a rotatable first gear mounted in said housing, said first gear having a notch on the periphery between two of the teeth, said notch being in alignment with said guide at the initial position of said first gear, a hollow cylindrical protrusion fixably mounted on the face of said first gear, said protrusion having a lateral grove positioned in alignment with said notch, a motor within said housing, a second gear meshed with said first gear, the gear ratio between said first and said second gears being such that upon one revolution of said second gear the first gear will revolve more than once, a cam affixed to said second gear, said cam having an indentation thereon, a cam follower in contact with said cam, a first switch for energizing said motor, a second switch for deenergizing said motor when said cam follower detects one full revolution of said cam, means for moving the housing to an operating position such that said notch is offset from the axis of said terminal, means for activating said first switch when said housing is in operating position, means for pivoting said housing away from said holder upon activation of said second switch such that the wire is broken, and, means for feeding wire into the apparatus such that the wire fits through said guide into said notch when the housing is moved into operating position and that tension is maintained on the wire throughout the operation.

* * * * *